US008381654B2

(12) United States Patent
Osterman

(10) Patent No.: US 8,381,654 B2
(45) Date of Patent: Feb. 26, 2013

(54) EXPLOSIVE CHARGING

(75) Inventor: Rauf Osterman, Victoria Point (AU)

(73) Assignee: Dyno Nobel Asia Pacific Pty Limited, Southbank, VIC (AU)

( * ) Notice: Subject to any disclaimer, the term of this patent is extended or adjusted under 35 U.S.C. 154(b) by 0 days.

(21) Appl. No.: 13/127,262

(22) PCT Filed: Nov. 6, 2009

(86) PCT No.: PCT/AU2009/001442

§ 371 (c)(1),
(2), (4) Date: Sep. 16, 2011

(87) PCT Pub. No.: WO2010/051588

PCT Pub. Date: May 14, 2010

(65) Prior Publication Data

US 2011/0315037 A1 Dec. 29, 2011

(30) Foreign Application Priority Data

Nov. 6, 2008 (AU) ..... 2008905746

(51) Int. Cl.
*F42D 1/10* (2006.01)

(52) U.S. Cl. ..... 102/313; 86/20.15; 299/13

(58) Field of Classification Search ..... 102/311, 102/312, 313; 86/20.15; 299/13
See application file for complete search history.

(56) References Cited

U.S. PATENT DOCUMENTS

| | | | | |
|---|---|---|---|---|
| 3,541,797 | A | 11/1970 | Stewart | |
| 5,105,743 | A | 4/1992 | Tano et al. | |
| 5,584,222 | A | 12/1996 | Engsbraten et al. | |
| 6,070,511 | A * | 6/2000 | Palmer et al. | 86/20.15 |
| 6,397,719 | B1 * | 6/2002 | Vestre | 86/20.15 |
| 6,397,754 | B1 | 6/2002 | Perlid | |
| 6,453,818 | B1 * | 9/2002 | Brent | 102/313 |
| 2011/0297030 | A1 * | 12/2011 | Zimmermann | 102/312 |

OTHER PUBLICATIONS

International Search Report: mailed Jan. 13, 2010: Appln. No. PCT/AU2009/001442.

* cited by examiner

*Primary Examiner* — James Bergin
(74) *Attorney, Agent, or Firm* — Ladas & Parry LLP

(57) ABSTRACT

A method of charging explosives in a substantially vertical blast borehole, with a loading density reduced in relation to that corresponding to the complete fill up of the borehole diameter. The method includes the step of introducing a charging hose in fluid connection with a nozzle into an end opening of the vertical blast borehole. The charging hose and nozzle are then moved along the blast borehole along a travel direction at a controlled rate. As the nozzle is being moved, an explosive emulsion is forced though the nozzle at a controlled pumping rate such that the emulsion is sprayed by the nozzle laterally relative to the travel direction, in an arc formation extending around an axis of the nozzle, which axis is parallel to the travel direction, and onto an inner wall of the blast hole. The pumping rate and the controlled moving rate are adjusted so as to form a coherent string of the explosive emulsion exiting from the nozzle, whereby the string only partially fills up the blast borehole diameter.

7 Claims, 3 Drawing Sheets

EXPLOSIVE CHARGING

TECHNICAL FIELD

The present invention relates to explosive charging, and in particular to a method of charging a substantially vertical borehole with a coherent string exiting from a hose end opening, wherein the exiting string only partially fills up the borehole diameter. This can best be described as vertical string charging.

Accordingly; the present invention relates to a method for charging explosives in a substantially vertical blast borehole, with a loading density reduced in relation to that corresponding to the complete fill up of the borehole diameter with the explosive in bulk form.

BACKGROUND ART

In the mining environment, explosive charges are used to remove rock and other ground material as part of normal mining operations. Explosive emulsions are often used to provide the explosive energy. Such emulsions are fluid or viscous cohesive matter which can be sprayed into the locations where it will be used.

A typical arrangement for the purposes of explosive removal is to have an underground, substantially horizontal passageway (drive), with downwardly extending hollow shafts or "blast holes". Such blast holes are often arranged to fan outwardly in a downward or upward direction from the drives in a series of blast holes transversely from the direction of the drive. Accordingly, such formations are known as "fanned rings". Indeed, there are usually a number of adjacent groups of fanned rings, with their openings into the floor of the passageway being arranged in rows.

It is important to carefully control the energy of the explosive forces used, to effect perimeter and brow control of blasting in mining production areas and to effect suitable explosive energy distribution in fanned rings. In particular, it is important to minimize undesirable damage to surrounding rock and earth matter, and thereby delimit the zone in which the explosive energy will remove such rock and other matter during blasting.

Also, given the fan-like arrangement of the rings, it will be appreciated that the rings are closer to one another at their upper ends than at their lower ends. Accordingly, the explosive forces required to remove the intermediate rock and other matter needs to be less towards the upper ends of the rings given the compounded effect of the explosions in the multiplicity of adjacent rings.

One method of achieving this is to reduce the density of the explosive charges in an upward direction, towards the upper ends of the rings. However explosive emulsions are not particularly practical for such use for reasons mentioned below.

The density of the emulsion can be reduced by an aerating process and this reduction in density can be used to lower the explosive energy capabilities towards the upper ends of the rings. However, in order for the explosive emulsions to be effective, the minimum desirable density is 0.8 g/cm$^3$.

To compensate for the minimum effective density of the emulsions, in addition to reducing the density, the overall compounded explosive energy can also be reduced by providing the explosive emulsions up to different heights in the respective rings, to form a staggered arrangement. However, this process of inserting such emulsions is cumbersome and time-consuming and not particularly effective.

Another problem of the known method of spraying explosive emulsion in blast holes is that the overall weight of the emulsion in the blast hole is such that, as a result of hydrostatic pressures and the reology of the emulsion, only a limited column height of the emulsion (usually 35 m to 45 m depending on whether the emulsion is applied in an up-hole or down-hole direction) can be supported.

Another available method of reducing explosive energy is to use so-called decoupled explosive products. In the above-mentioned environment, this might take the form of explosive materials or emulsions which do not fully fill the blast holes, but which have open spaces between the explosive material and the surfaces (inner walls) of the holes. The open spaces allow dissipation of the explosive energy.

U.S. Pat. No. 5,584,222 (Engsbraten et al) discloses a method for charging explosives in substantially horizontal boreholes. The method comprises the steps of introducing a charging hose with an end opening into at least one substantially horizontal borehole of a blasting round. A pumpable and coherent bulk explosive is then pumped through the charging hose at a controlled rate, and simultaneous with the pumping of the explosive, the hose is withdrawn at a controlled rate. In this way, the pumping and withdrawal rates are adjusted to form a coherent string exiting from the hose end opening. The exiting string only partially fills up the borehole diameter. This can best be described as horizontal string charging.

In other words, the exiting string of explosive has a diameter that is considerably smaller than the diameter of the substantially horizontal bore hole. As the borehole is substantially horizontal, under the influence of gravity, the exiting string sits on only the lower surface of the borehole. It can be appreciated that such a system would therefore not be particularly suitable for substantially vertical bore holes, as the overall weight of the emulsion and as a result of hydrostatic pressures, the emulsion would not stick to the side walls of the vertical boreholes.

One previous attempt at providing a method and apparatus for charging boreholes with explosives, which is suitable for use with substantially vertical boreholes, is described in U.S. Pat. No. 6,397,754 (Perlid). This document discloses a method and a device for charging boreholes with explosives. One end of the charging hose is introduced to a substantially predetermined distance from the bottom of the borehole. Subsequently, a pumpable explosive is pumped through the charging hose at a controlled rate and substantially simultaneously with the pumping of the explosive the charging hose is withdrawn from the borehole at a controlled rate.

Unlike the method described in U.S. Pat. No. 5,584,222, in U.S. Pat. No. 6,397,754, the explosive is caused to flow out from a nozzle, arranged on the end of the charging hose, in the form of a hollow cone and at high pressure, so that the outflowing explosive is given increased viscosity and by virtue of the high outflow rate cohesively adheres to the entire cylinder-shaped wall portion of the borehole, upon which the explosive impinges in connection with the outflowing. With the aid of a centering device, the nozzle is centred in the borehole.

In other words, the nozzle is adapted to spray the explosive in the form of a hollow cone towards the cylinder-shaped wall of the borehole, where the explosive is deposited as a ring in the borehole. This can best be described as vertical, cylindrical decoupled charging.

It is an object of the present invention to provide an explosive charging, and in particular a method of charging that overcomes or ameliorates the disadvantages of the prior art, or at least provides a useful alternative thereto.

DISCLOSURE OF THE INVENTION

According to a first aspect of the present invention there is provided a method of charging explosives in a substantially vertical blast borehole, with a loading density reduced in relation to that corresponding to the complete fill up of the borehole diameter, the method including the steps of: introducing a charging hose in fluid connection with a nozzle into an end opening of the vertical blast borehole; moving the charging hose and nozzle along the blast borehole along a travel direction at a controlled rate; as the nozzle is being moved, forcing an explosive emulsion though the nozzle at a controlled pumping rate such that the emulsion is sprayed by the nozzle laterally relative to the travel direction, in an arc formation extending around an axis of the nozzle, which axis is parallel to the travel direction, and onto an inner wall of the blast hole; and adjusting the pumping rate and the controlled moving rate so as to form a coherent string of the explosive emulsion exiting from the nozzle, whereby the string only partially fills up the blast borehole diameter.

Preferably, step (iii) includes forcing the explosive emulsion though the nozzle such that the emulsion is sprayed by the nozzle at a spray angle to said direction of travel, the spray angle being in the range of 75 to 85 degrees.

Preferably, step (ii) includes moving the nozzle along the blast hole in the travel direction at a varying speed, which varies at a steady rate, while step (iii) includes forcing the explosive emulsion at a substantially constant rate, such that the volume of explosive emulsion sprayed onto the inner wall, per unit length of the blast hole, varies along the blast hole.

Preferably, the nozzle is adapted to spray said emulsion in said arc formation.

Preferably, igniting means are introduced into the borehole. The igniting means are positioned close to the bore-hole innermost part and that the pumping and withdrawal rates are adjusted to give an explosive amount at the igniting means in excess of the string amount in the main part of the bore-hole length. The excess amount is obtained by a delay of hose withdrawal after the start of pumping.

In this specification, the word "vertical" or "vertically" (for example in the expression "vertical string") is to be understood as meaning upright or uprightly, respectively, or upward or upwardly, respectively, unless the context clearly indicates otherwise and is thus not to be interpreted to mean literally vertical or vertically.

Also, within this specification a string is a line of explosive that only partially fills up the borehole diameter, having a diameter that is considerably smaller than the diameter of the borehole.

BRIEF DESCRIPTION OF THE DRAWINGS

Preferred embodiments of the invention will now be described, by way of example only, with reference to the accompanying drawings in which.

BEST MODE FOR CARRYING OUT THE INVENTION

The present invention generally relates to explosive charging, and in particular to a method of charging a substantially vertical borehole 50 with a coherent string 30 exiting from a hose end opening 16, wherein the exiting string only partially fills up the borehole diameter. This can best be described as vertical string charging.

Figure 1:
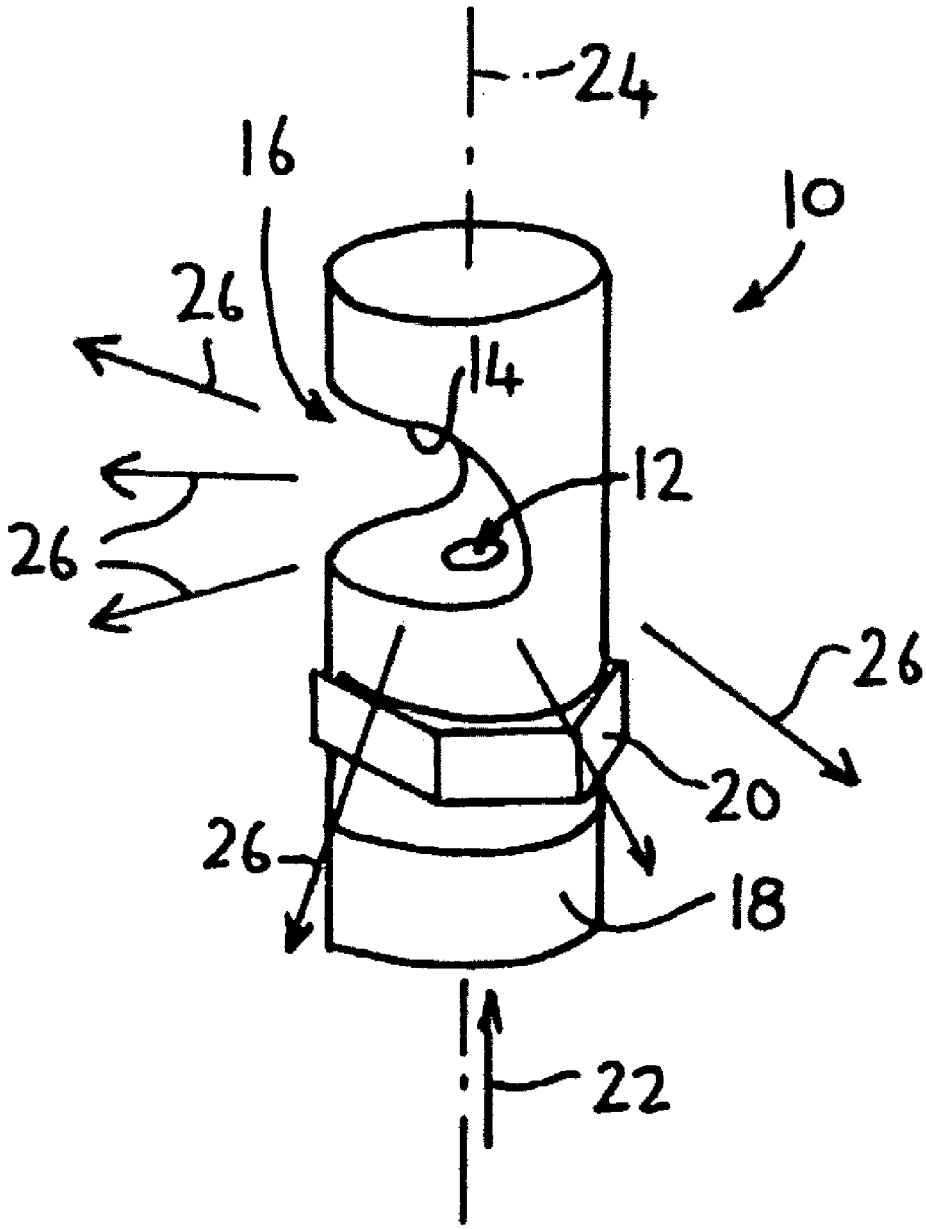
FIG. 1 is a schematic perspective view of a "180° nozzle" in accordance with a first aspect of the present invention.

Referring to FIG. 1 there is shown a schematic representation of a commercially available nozzle 10 which can be used to perform part of a method according to an embodiment of the invention, as described below.

The nozzle 10 includes an inner passage (not shown) opening out through an aperture 12, above which there is a deflection wall 14, with an exit opening 16 at the periphery of the deflection wall, the opening extending partially around the aperture.

The nozzle 10 also includes a screw thread 18 and a spanner engagement formation 20. The nozzle 10 is adapted to be connected to a hose (not shown in FIG. 1), by means of a spanner or other suitable tool engaging the spanner engagement formation 20, for use in spraying an explosive emulsion (also not shown in FIG. 1).

The emulsion is directed by the hose into the nozzle 10 as indicated by the arrow 22, so that the emulsion exits via the aperture 12 and is then deflected by the deflection of wall 14. In this manner, the emulsion can be sprayed, by the nozzle 10, in a formation extending 180° to 200° about an axis 24 of the nozzle as indicated by the arrows 26. It will be appreciated that the spray formation around the nozzle 10 is thus arc-shaped.

Figure 2:
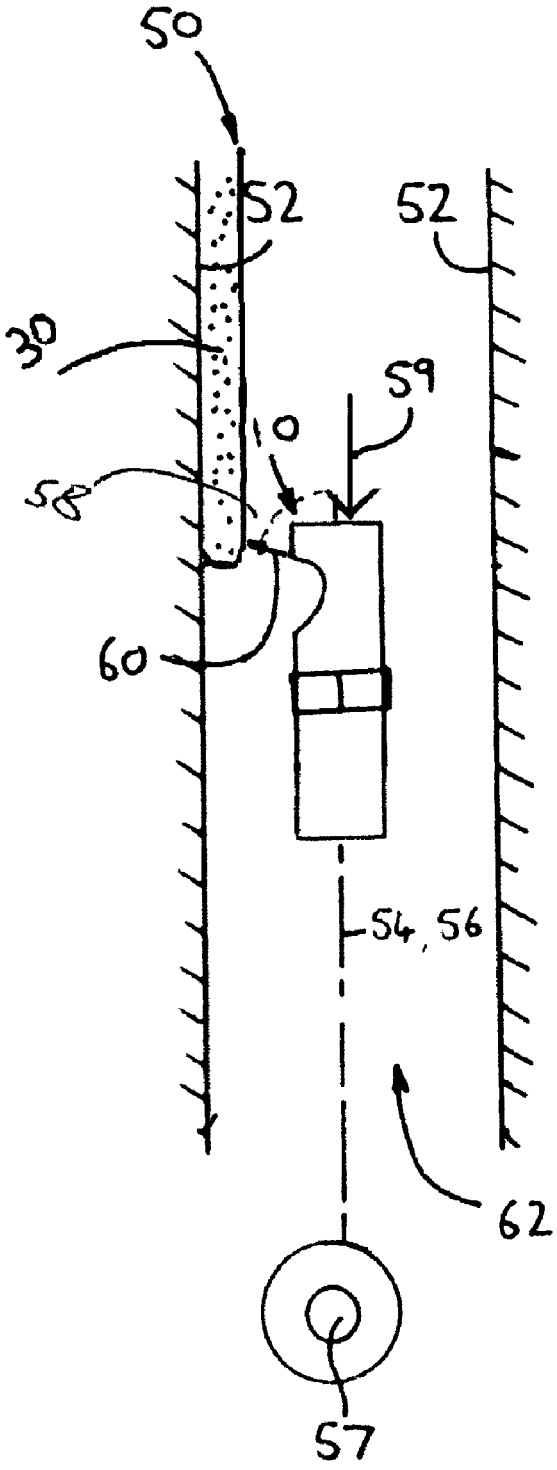
FIG. 2 is a schematic section view through a blast hole in which a method according to an embodiment of the invention is performed, illustrating the spraying of an arc of explosive emulsion onto the inner wall of the blast hole utilising the nozzle of FIG. 1.

Referring now to FIG. 2, there is shown, schematically, a cross-section through a vertical blast borehole 50 in a mine. The blast borehole 50 is substantially tubular, having an inner wall 52.

There is shown, disposed in the vertical blast borehole 50, a nozzle 10 which is for up-hole charging of the blast borehole. The nozzle 10 is attached to a hose 54 (indicated in phantom lines), which is, in turn, connected to a source of explosive emulsion, which is not shown in FIG. 2.

There is also provided a means 56, also shown in phantom lines, for drawing the nozzle 10 upward through the vertical blast borehole 50. In a preferred embodiment, the means 56 is constituted by the hose 54.

The means 56 for moving the nozzle 10 through the vertical blast borehole 50 is connected to a computer-actuated controller 57, which controls the rate at which the means pulls the nozzle through the vertical blast borehole.

In use, the hose 54 is adapted to direct explosive emulsion into the nozzle 10, and the nozzle then sprays the emulsion laterally outwards in an arcuate pattern, onto the inner wall 52, as indicated by the arrows 60.

Figure 3:
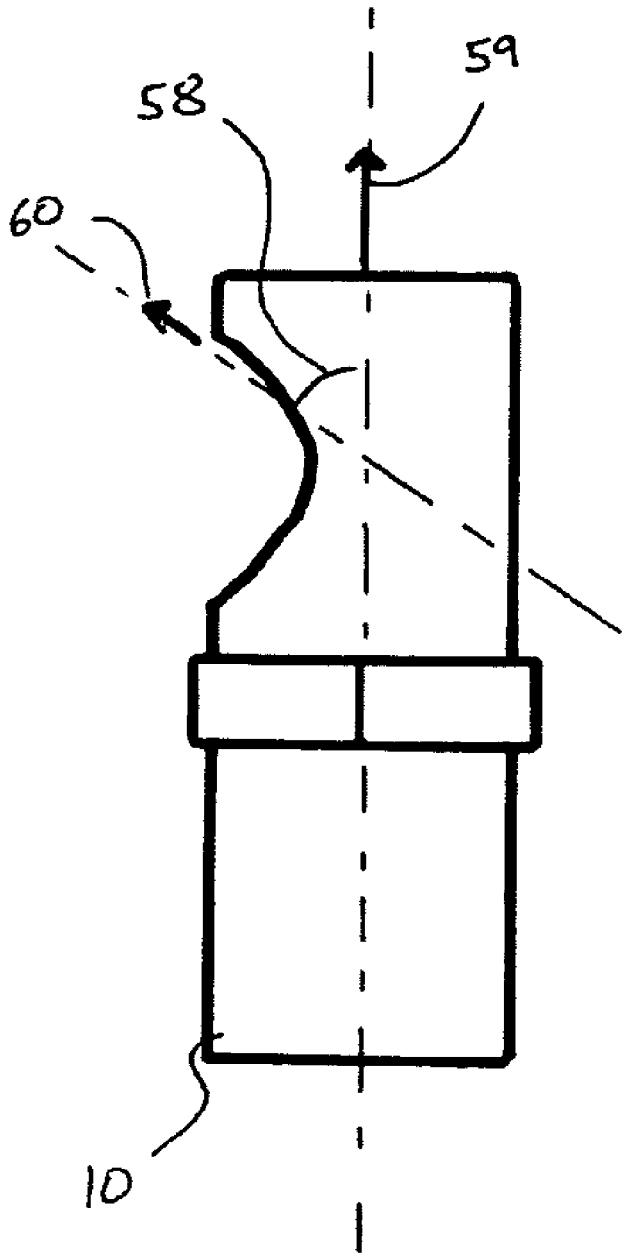
FIG. 3 is an enlarged schematic sectional view of the spraying angle of the nozzle shown in FIG. 1.

As best shown in FIG. 3, the configuration of the nozzle 10, and in particular the deflection wall 14, is such that the angle 58 at which the emulsion is sprayed is in the range of 75° to 85° from the direction of travel of the nozzle 10 through the vertical blast borehole 50. This direction, which is substantially parallel to the axis 24 of the nozzle 10, is indicated by the arrow 59, and the direction of spraying is indicated by the arrows 60.

The rate at which the controller 57 causes the nozzle 10 to move through the vertical blast borehole 50, and the rate at which the emulsion is sprayed from the nozzle in an arcuate dispensing pattern, is such that the emulsion forms a coherent vertical string 30 on a portion of the inner wall 52 of the vertical blast borehole. This leaves a substantial portion of the inner diameter of the blast borehole 50 substantially free of the explosive emulsion.

By forming a coherent vertical string 30 of pumpable explosive, which only partially fills out the blast borehole diameter 50, several objectives are reached.

The explosive itself need not be highly diluted, with corresponding problems, but energy reduction is accomplished by amount and string size. Variability in specific loading is obtained and specifically it is possible also to charge some bore-holes in their entirety with utilization of the full power of a bulk explosive. Yet, the most pronounced advantages are obtained in cautious blasting with thin strings of the explosive. It has been found that a pumpable bulk explosive string, uncoupled from the bore-hole wall and spacing devices, neither behaves as confined nor as unconfined, with high detonation velocities. Rather it detonates with a markedly reduced velocity and shock generation, perfectly meeting the requirements in cautious blasting. The charging method outlined and the detonation mechanism obtained sustains a stable and undisturbed detonation also in thin strings, contrary to previous experience.

As the nozzle 10 is pulled through the vertical blast borehole 50, the speed of movement is controlled by the controller 57, such that the speed increases, while the rate of spraying of the explosive emulsion remains essentially constant. As a result, the volume of explosive emulsion that is sprayed per unit length (e.g. per meter) of the vertical blast borehole 50 decreases along the upward length of the blast borehole.

According to the preferred embodiment, the speed increases uniformly, with the result that the volume per unit length decreases uniformly. This assists in enabling a reducing volume per unit length of explosive charge, from the lower end of the vertical blast borehole 50 to the upper end thereof.

The angle 58 as mentioned above has been found to be advantageous as it assists in causing the coherent string of the explosive emulsion 30 to stick effectively to the inner wall 52 of the vertical blast hole 50.

The coherent vertical string 30 of explosive emulsion, which leaves a substantial portion of the inner diameter of the blast borehole 50 substantially free of the explosive emulsion is advantageous as the area that is substantially free of the explosive emulsion results in the emulsion constituting a decoupled charge, which is useful in limiting and controlling the explosive energy available on detonation of the charge.

Another advantage of the coherent vertical string of explosive emulsion is that configuration of the sprayed emulsion assists in avoiding problems of hydrostatic pressures. As mentioned above, such pressures in the prior art can limit the maximum height of the column of explosive emulsion that can be used. The reduction in such hydrostatic pressures can enable a column of increased, or possibly even unlimited, height to be achieved (subject, of course, to the height of the blast hole itself, the charge hose, etc).

Although the invention is described above with reference to specific embodiments, it will be appreciated by those skilled in the art that it is not limited to those embodiments, but may be embodied in many other forms.

Industrial Applicability

The present invention can be used in respect of explosive charging, and in particular to a method of charging a substantially vertical borehole with a coherent string exiting from a hose end opening, wherein the exiting string only partially fills up the borehole diameter. This can best be described as vertical string charging.

The invention claimed is:

1. A method of charging explosives in a substantially vertical blast borehole, with a loading density reduced in relation to that corresponding to the complete fill up of the borehole diameter, the method including the steps of:

(i) introducing a charging hose in fluid connection with a nozzle into an end opening of the vertical blast borehole;

(ii) moving the charging hose and nozzle along the blast borehole along a travel direction at a controlled rate;

(iii) as the nozzle is being moved, forcing an explosive emulsion though the nozzle at a controlled pumping rate such that the emulsion is sprayed by the nozzle laterally relative to the travel direction, in an arc formation extending around an axis of the nozzle, which axis is parallel to the travel direction, and onto an inner wall of the blast hole; and (iv) adjusting the pumping rate and the controlled moving rate so as to form a coherent string of the explosive emulsion exiting from the nozzle, whereby the string only partially fills up the blast borehole diameter.

2. A method of charging explosives in a substantially vertical blast borehole of claim 1 wherein step (iii) includes forcing the explosive emulsion though the nozzle such that the emulsion is sprayed by the nozzle at a spray angle to the direction of travel, the spray angle being in the range of 75 to 85 degrees.

3. A method of charging explosives in a substantially vertical blast borehole of claim 1 wherein step (ii) includes moving the nozzle along the blast hole in the travel direction at a varying speed, which varies at a steady rate, while step (iii) includes forcing the explosive emulsion at a substantially constant rate, such that the volume of explosive emulsion sprayed onto the inner wall, per unit length of the blast hole, varies along the blast hole.

4. A method of charging explosives in a substantially vertical blast borehole of claim 1 wherein the nozzle is adapted to spray the emulsion in the arc formation.

5. A method of charging explosives in a substantially vertical blast borehole of claim 1 wherein igniting means are introduced into the bore-hole.

6. A method of charging explosives in a substantially vertical blast borehole of claim 5 wherein the igniting means are positioned close to the bore-hole innermost part and that the pumping and withdrawal rates are adjusted to give an explosive amount at the igniting means in excess of the string amount in the main part of the bore-hole length.

7. A method of charging explosives in a substantially vertical blast borehole of claim 5 wherein the excess amount is obtained by a delay of hose withdrawal after the start of pumping.

* * * * *